US005600201A

United States Patent [19]

Yun et al.

[11] Patent Number: 5,600,201

[45] Date of Patent: Feb. 4, 1997

[54] ELECTRON GUN FOR A COLOR CATHODE RAY TUBE

[75] Inventors: Neung-Yong Yun, Seoul; Heon-Chang Kim; Han-Shin Do, both of Kyungki-do; Il-Tae Kim, Seoul, all of Rep. of Korea

[73] Assignee: Samsung Display Devices Co., Ltd., Kyungki-do, Rep. of Korea

[21] Appl. No.: 443,024

[22] Filed: May 17, 1995

Related U.S. Application Data

[63] Continuation-in-part of Ser. No. 242,089, May 12, 1994, abandoned.

[30] Foreign Application Priority Data

Oct. 22, 1993 [KR] Rep. of Korea ..... 93-22019
Dec. 31, 1993 [KR] Rep. of Korea ..... 93-32276

[51] Int. Cl.[6] ..... H01J 29/54

[52] U.S. Cl. ..... 313/414; 313/412; 313/447; 313/449

[58] Field of Search ..... 313/414, 447, 313/426, 427, 412, 458, 449, 446; 445/47; 315/382, 14, 15

[56] References Cited

U.S. PATENT DOCUMENTS

| | | | |
|---|---|---|---|
| 4,234,814 | 11/1980 | Chen et al. | 313/412 |
| 4,251,747 | 2/1981 | Burdick | 313/414 |
| 4,473,775 | 9/1984 | Hosokoshi et al. | 315/14 |
| 4,523,123 | 6/1985 | Chen | 313/412 |
| 4,629,933 | 12/1986 | Bijma et al. | 313/414 |
| 4,736,133 | 4/1988 | Barbin et al. | 313/414 |
| 5,066,887 | 11/1991 | New | 313/414 |
| 5,126,625 | 6/1992 | Cho | 313/414 |
| 5,208,507 | 5/1993 | Jung | 313/414 |
| 5,262,702 | 11/1993 | Shimoma | 315/382 |
| 5,350,967 | 9/1994 | Chen | 313/413 |

*Primary Examiner*—Sandra L. O'Shea
*Assistant Examiner*—Vip Patel
*Attorney, Agent, or Firm*—Leydig, Voit & Mayer

[57] ABSTRACT

An electron gun for a color cathode ray tube having a cathode, a control electrode and a screen electrode together constituting of a triode, and a main lens for focusing and accelerating an electron beam formed by the triode. The electron gun is characterized by a horizontally elongated electron beam passing hole formed in the control electrode having its long axis disposed in the arrangement direction of the electron beam passing hole. A horizontally elongated slot encompassing the electron beam passing hole having its long axis disposed in the arrangement direction of the electron beam passing hole is formed in the screen electrode opposed to the control electrode, thereby preventing the focusing characteristics of the electron beam from being reduced throughout the surface of the fluorescent layer by the influence of the deflection yoke.

8 Claims, 8 Drawing Sheets

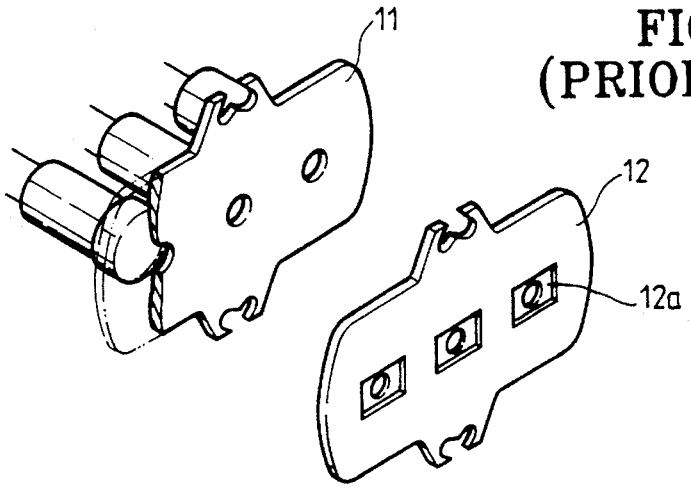
FIG.1
(PRIOR ART)
FIG.2
(PRIOR ART)
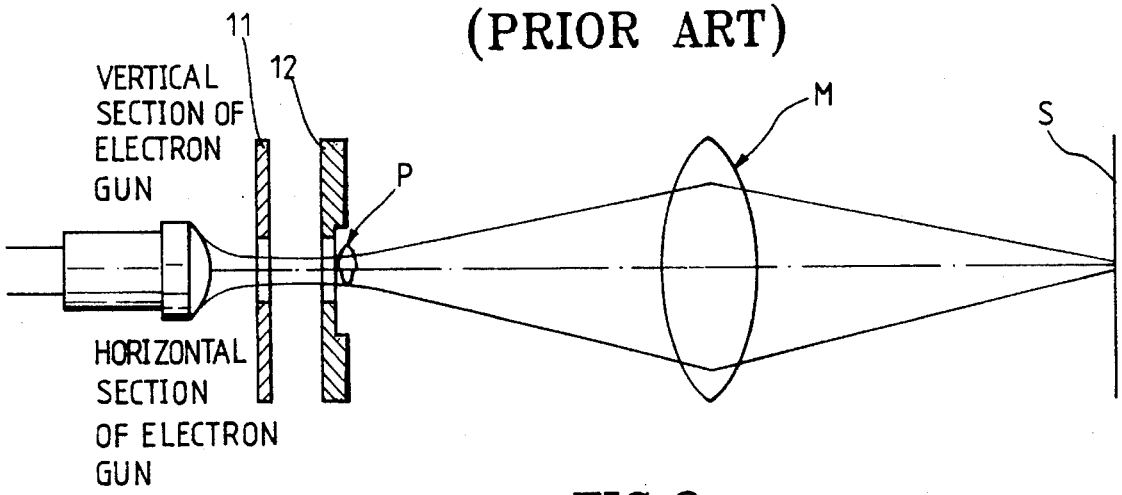
FIG.3
(PRIOR ART)
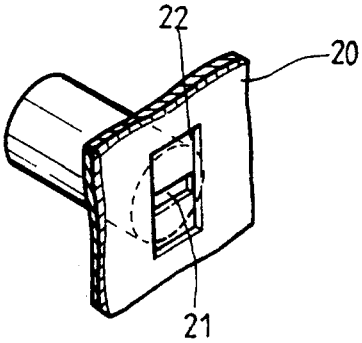

ELECTRON GUN FOR A COLOR CATHODE RAY TUBE

This is a continuation-in-part of application Ser. No. 08/242,089, filed May 12, 1994, now abandoned.

BACKGROUND OF THE INVENTION

The present invention relates to an electron gun for a color cathode ray tube, and more particularly, to an electron gun for a color cathode ray tube which can reduce haze around an electron beam spot generated when a vertical electron beam is over-focused by a nonhomogeneous magnetic field of a deflection yoke to thereby land on a fluorescent layer.

In general, an electron gun for a color cathode ray tube, mounted in the neck section of a cathode ray tube for emitting electron beams, comprises a cathode, a control electrode and a screen electrode, which form a pre-triode, a plurality of focus electrodes and anode electrodes for converging and accelerating an electron beam, in each of which three circular electron beam passing holes are formed.

Since the conventional electron gun for a color cathode ray tube constructed as described above converges and accelerates the electron beam generated from the cathode without changing its surface shape, when the electron beam is deflected to the periphery of a fluorescent layer under the influence of a deflection yoke, the electron beam is distorted by a nonhomogeneous magnetic field, thereby making it impossible to obtain a sharp picture.

To solve the aforementioned problem, as shown in FIG. 1, in the prior art, a recessed and horizontally elongated slot 12*a* is formed in the emitting surface of the screen electrode 12 located adjacent to the control electrode 11 of a triode to thereby correct for the influence of the nonhomogeneous magnetic field of the deflection yoke.

As described above, the formation of the horizontally elongated slot 12*a* in the emitting surface of the screen electrode 12 is for reducing the spherical aberration occurring within a main lens M and a deflection magnetic field and the perpendicular deflection distortion. However, it requires the prefocus lens P to be strengthened, thereby increasing the magnification of the pre-focus, causing the beam radius within the prefocus lens P to be reduced, thereby enlarging the virtual object point of a perpendicular beam, and finally resulting in the increase of the radius of the electron beam spot landing on a screen surface S. Therefore, although the deflection distortion in the center of the screen is reduced, since the radius of the electron beam spot therein is increased, the overall resolution is reduced, centering around the screen center which is a most vital part in the cathode ray tube. In other words, the image resolution in the periphery of the screen can be improved but the resolution in the center thereof is reduced.

To solve the aforementioned problem, as disclosed in U.S. Pat. No. 4,629,933 and shown in FIG. 3, in the prior art, an electron beam passing hole 21 of a control electrode 20 is formed as a horizontally elongated type and a vertically elongated slot 22 is formed in the emitting surface thereof, thereby forming and using horizontal and vertical crossover points differently. However, this may lower the focusing characteristics in the high current area. Also, since the slot 22 should be formed in the thin control electrode 20, the slot is manufactured such that a member wherein the slot 22 is formed is attached to the control electrode 20, or the control electrode 20 is compressing-processed. However, in case where the slot 22 is formed in the control electrode by welding the slot member thereto, the alignment which is a vital factor in the quality of an electron gun is deteriorated. Also, in case the control electrode 20 is compressing-processed, it is difficult to manufacture an electrode by means of molding.

Also, in U.S. Pat. No. 4,234,814 a conventional electron gun is disclosed in which a beam shape is elliptical at a main lens by making a crossover point of the electron beam emitted from a cathode different. The electron gun has a structure wherein a circular electron beam passing hole 25H is formed on a control electrode 25 and a horizontally elongated recess 26*s* is formed in the receiving surface of a screen electrode 26 formed opposingly thereto, as shown in FIGS. 4A and 4B.

The electron gun increases a vertical electron beam diverging power by the horizontally elongated recess 26*s* formed on the screen electrode 26 so that the crossover point of the vertical electron beam is positioned far from the cathode but the crossover point of the horizontal electron beam is positioned comparatively near the cathode.

In such a manner, positioning the crossover point of the vertical electron beam far from the cathode reduces the incident angle of the vertical electron beam with respect to the crossover point and reduces the emitting angle thereof from the crossover point, thereby making the diameter of the vertical electron beam in the main lens small.

Accordingly, the diameter of the vertical electron beam can be reduced in both the main lens and deflection field so that the electron beam haze due to a spherical aberration and deflection aberration is reduced. However, the object point radius cannot be reduced even by reducing the electron beam passing hole of the control electrode 25, which is one of the vital factors of determining focus characteristics. Thus, there is a limit in obtaining good focus characteristics.

SUMMARY OF THE INVENTION

To solve the above problems, it is an object of the present invention to provide an electron gun for a color cathode ray tube which can compensate for the electron beam distortion occurring due to the nonhomogeneous magnetic field of a deflection yoke.

Another object of the present invention is to provide an electron gun for a color cathode ray tube whose focusing characteristics on the overall fluorescent surface are improved.

To accomplish the above objects, an electron gun for a color cathode ray tube according to the present invention having a triode constituted by three cathodes, a control electrode having three electron beam passing holes formed thereon in an in-line configuration and a screen electrode, and a main lens for focusing and accelerating the electron beam formed by the triode, is characterized in that each horizontally elongated electron beam passing hole having a long axis thereof disposed in the arrangement direction of the electron beam passing hole is formed in the control electrode, and a horizontally elongated slot encompassing the electron beam passing hole and having a long axis thereof disposed in the arrangement direction of the electron beam passing hole which is recessed from the incident surface of the screen electrode is formed in the incident surface of the screen electrode opposed to the control electrode.

Also, an electron gun for a color cathode ray tube according to the present invention having a triode comprising three cathodes, a control electrode having three electron beam passing holes formed thereon in an in-line configuration and a screen electrode, and a main lens for focusing and accelerating the electron beam formed by the triode, is characterized in that each horizontally elongated electron beam passing hole having a long axis thereof disposed in the arrangement direction of the electron beam passing hole is formed in the control electrode, the screen electrode is opposed to the control electrode, and a first member having three horizontally elongated slots formed therein and a second member opposed to the main lens and having three electron beam passing holes formed therein are coupled so that each slot formed in the first member encompasses each electron beam passing hole formed in the second member.

Further, an electron gun for a color cathode ray tube according to the present invention having a triode comprising by three cathodes, a control electrode having three electron beam passing holes formed thereon in an in-line configuration and a screen electrode, and a main lens for focusing and accelerating the electron beam formed by the triode, is characterized in that each horizontally elongated electron beam passing hole having a long axis thereof disposed in the arrangement direction of the electron beam passing hole is formed in the control electrode, the horizontally elongated slot recessed from the emitting surface of the screen electrode, which encompasses the electron beam passing hole formed in the screen electrode is formed in the emitting surface of the screen opposed to the main lens.

BRIEF DESCRIPTION OF THE DRAWINGS

The above objects and advantages of the present invention will become more apparent by describing in detail preferred embodiments thereof with reference to the attached drawings in which:

FIG. 1 is a partly extracted perspective view of a triode of a conventional electron gun for a color cathode ray tube;

FIG. 2 is an illustration depicting the horizontal and vertical tracks of the triode and electron beam of a conventional electron gun;

FIG. 3 is a partially cutaway perspective view showing another embodiment of the triode of a conventional electron gun;

DETAILED DESCRIPTION OF THE INVENTION

Figure 4A:
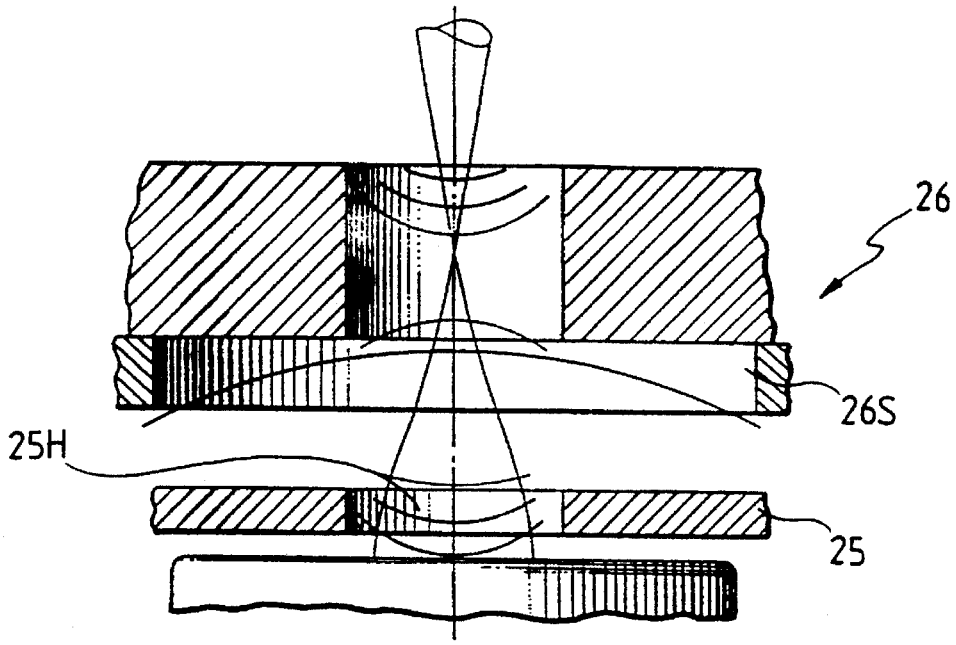
FIG.4A(PRIOR ART)
FIGS. 4A and 4B are horizontally and vertically cross-sectional views showing another embodiment of the triode of a conventional electron gun, respectively.
Figure 4B:
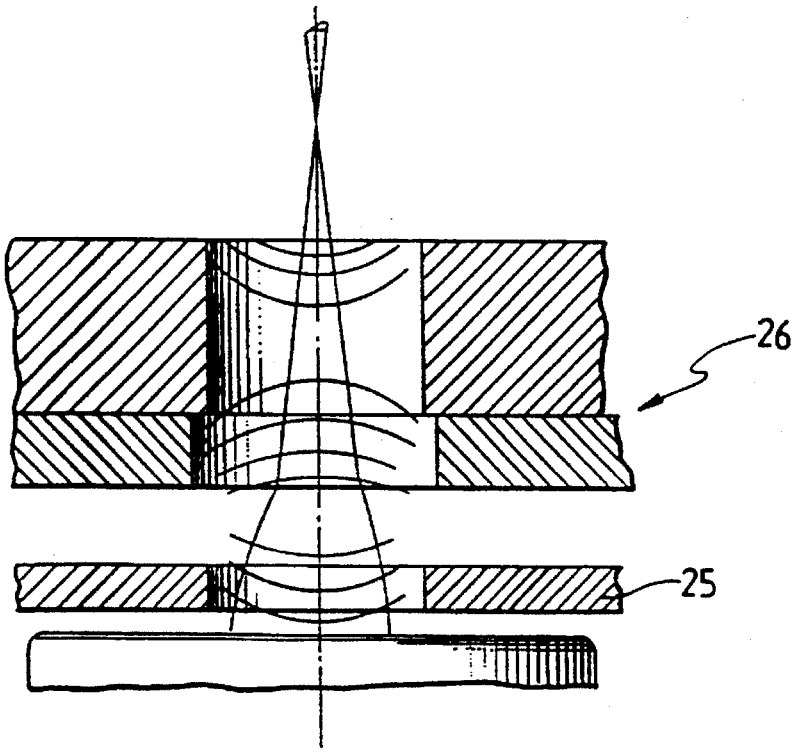
FIG.4B(PRIOR ART)
Figure 5:
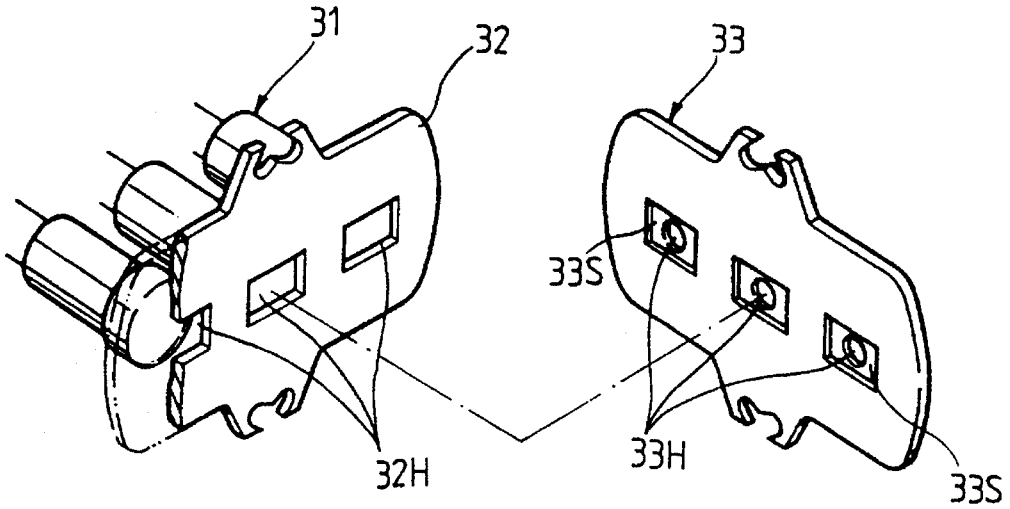
FIG. 5 is an exploded perspective view of the triode of the electron gun for a color cathode ray tube according to the present invention.
Figure 6:
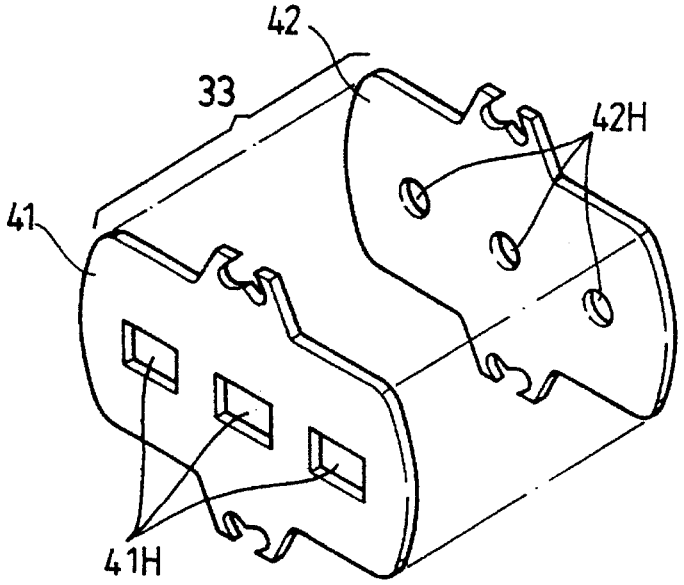
FIG. 6 is an exploded perspective view showing an embodiment of the screen electrode of the electron gun according to the present invention.

The electron gun for a color cathode ray tube according to the present invention includes a pre-triode and a plurality of electrodes comprising a main lens. The triode is constituted by a cathode 31, a control electrode 32 and a screen electrode 33, as shown in FIG. 5. Here, three horizontally elongated electron beam passing holes 32H are formed in the control electrode 32 in an in-line configuration. A trio of horizontally elongated slots 33S encompassing the electron beam passing holes 33H are formed in the incident surface of the screen electrode 33 opposed to the control electrode 32. The shape of the horizontally elongated electron beam passing holes 32H formed in the control electrode 32 can be a rectangle having its long axis disposed in the arrangement direction of the electron beam passing holes, or an oval or semi-oval shape having at least one oval-like side. Also, the horizontally elongated slots 33S formed in the screen electrode 33 are integrally formed in the screen electrode 33 by indenting the periphery of each electron beam passing hole 32H so as to be recessed from the incident surface of the screen electrode opposed to the control electrode 32. According to another embodiment, a first member 41 opposed to the control electrode 32 and having a horizontally elongated electron beam passing hole 41H formed therein, and a second member 42 opposed to the main lens and having a circular electron beam passing hole 42H formed therein are coupled with each other, as shown in FIG. 6. The horizontally elongated electron beam passing hole 41H formed in the first member 41 encompasses the circular electron beam passing hole 42H formed in the second member 42.

Figure 7:
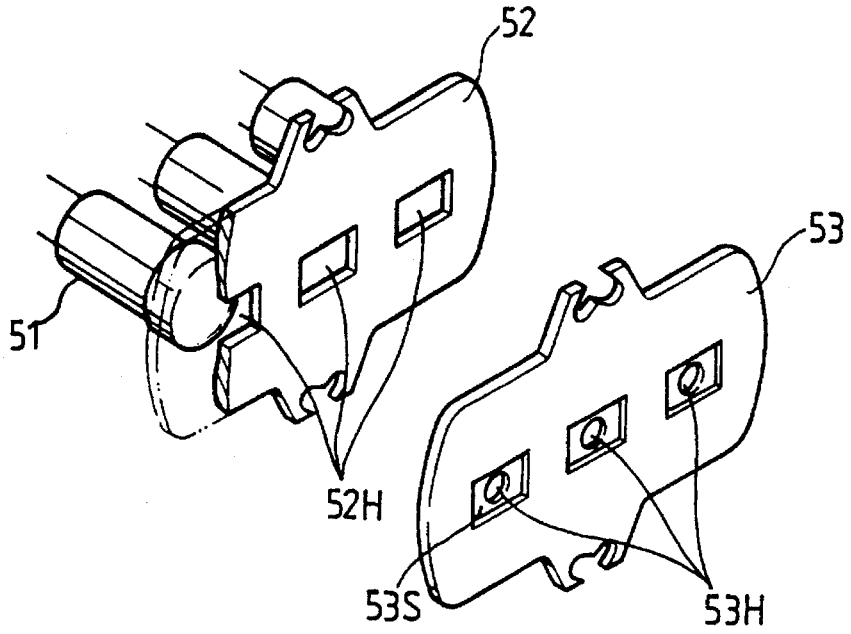
FIG. 7 is an exploded perspective view showing another embodiment of the triode of the electron gun for a color cathode ray tube according to the present invention.

Another embodiment of the electron gun for a color cathode tube according to the present invention is shown in FIG. 7.

Figure 8:
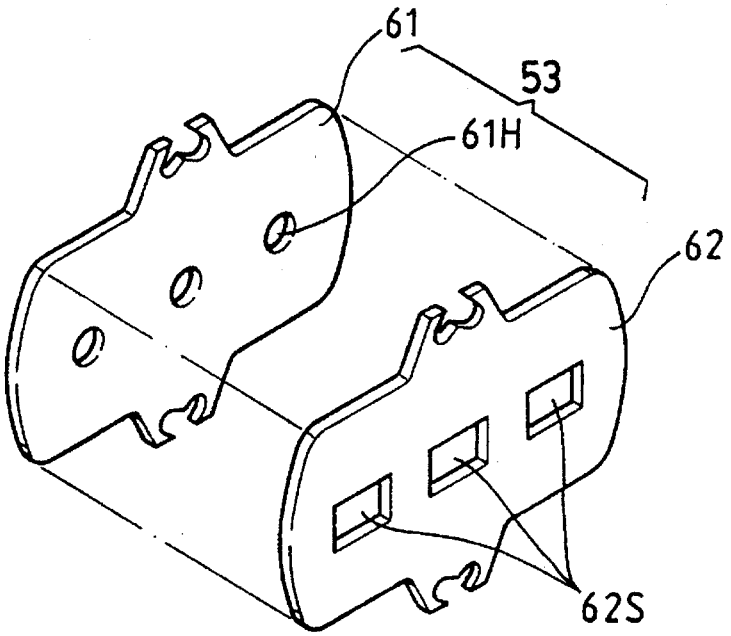
FIG. 8 is an exploded perspective view showing an embodiment of the screen electrode of the electron gun shown in FIG. 7.

Horizontally elongated electron beam passing holes 52H are formed in the control electrode 52 constituting the triode for the electron gun in an in-line configuration. Three electron beams passing holes 53H are formed in the screen electrode 53 formed adjacently with the control electrode 52 in an in-line configuration. Horizontally elongated slots **53*s* encompassing each electron beam passing hole 53H are formed in the emitting surface of the screen electrode 53 opposed to the main lens. The horizontally elongated slots 53*s* are formed so as to be recessed from the emitting surface of the screen electrode 53 and to have its long axis in the arrangement direction of the electron beam passing holes 53H. Here, the screen electrode is manufactured by coupling a first member 61 opposed to the control electrode and having three electron beam passing holes 61H formed therein with a second member 62 opposed with the main lens and having three horizontally elongated slots 62***s* formed therein, as shown FIG. 8. In this case, the widths of the horizontally elongated slots 62*s* should be larger in the arrangement direction of the electron beams than those of the electron beam passing holes 61H formed in the first member 61 so that the electron beam passing holes 61H can be encompassed.

The operation of the electron gun for a color cathode ray tube according to the present invention which is constructed as described above will now be explained hereinbelow.

An electron beam size which determines the resolution of an image in an electron gun is determined by the following equation.

$$D_S = \sqrt{(D_M + D_{SA})^2 + D_{SC}^2}$$

where $D_M$=m×dx.

At this time, $D_M$ is a magnification dimension, $D_{SA}$ is a spherical aberration dimension, $D_{SC}$ is a charge repulsion effect dimension, and m is magnification of the main lens.

An object point radius dx which determines the magnification dimension $D_M$ is dependent on the size of the electron beam passing hole of the control electrode. Also, the spherical aberration is proportional to $$\frac{r}{3R} \times \theta^3$$

where r is the beam radium at the main lens, R is the radius of the main lens, and θ is the incident angle of the beam on the main lens.

Meanwhile, as the space occupied by the beams in the main lens and deflection yoke system becomes larger, the beams are vertically distorted severely by the barrel-like vertical deflection magnetic field formed for deflecting the electron beams in the screen periphery, thereby lowering the resolution in the screen periphery. Also, the object point radius dx depends on the beam loading space in the cathode.

Based on the above relationship, although the completed electron gun for a color cathode ray tube according to the present invention is not shown in the drawing, as a predetermined electric potential is applied to the respective electrodes, electrons are thermally emitted from the cathode 31. Since the electron beam passing hole 32H formed in the control electrode 32 is formed with a horizontally elongated shape, the loading area which is a vertical section through which the electron beam emitted from the cathode 31 passes becomes less. Therefore, a defocussing effect can be reduced by sharply forming a beam having a small object point radius dx during emission and by decreasing the concentration of the vertical beam current severely distorted vertically due to the deflection yoke of the screen periphery deflection.

Figure 9:
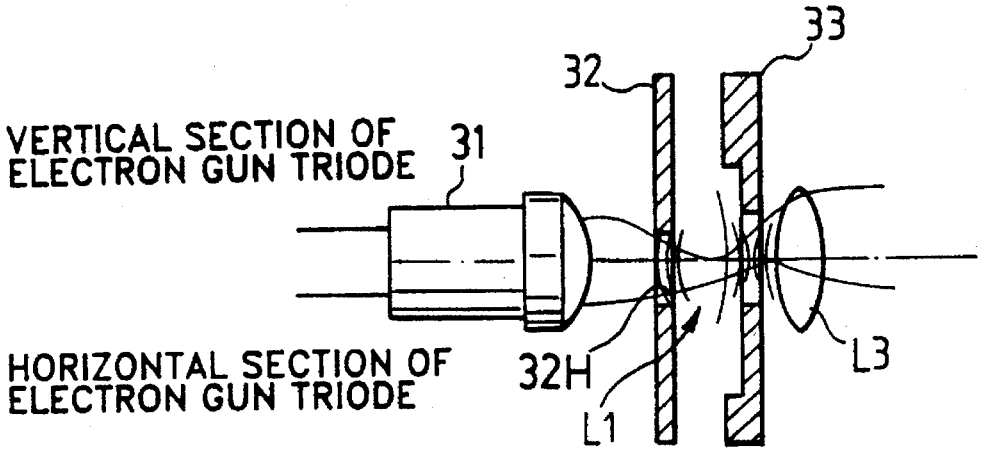
FIG. 9 is a cross-sectional view of the horizontally and vertically cut away sections of the triode of the electron gun according to the present invention taken on the basis of the center line thereof.
Figure 10:
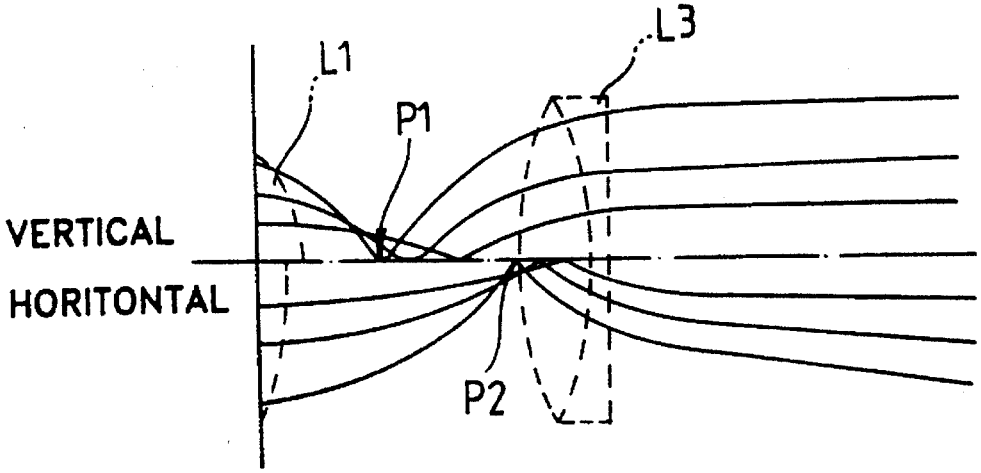
FIG. 10 depicts the tracks of vertical and horizontal electron beams emitted from the electronic lens formed in the triode and the cathode.

Also, as shown in FIGS. 9 and 10, since the electron beam passing hole 32H formed in the control electrode 32 is formed in a horizontally elongated shape, the cathode lens L1 formed between the cathode 31 and screen electrode 33 is horizontally weak and vertically strong. Therefore, the vertical electron beam emitted from the cathode 31 passes through the cathode lens L1 formed strongly in the vertical direction to then form a crossover point P1 at a position near from the cathode. Also, the horizontal electron beam emitted from the cathode 31 passes through the cathode lens L1 formed weakly in the horizontal direction to then form a crossover point P2 at a position relatively far from the cathode.

The vertical and horizontal electron beams having their respective crossover points have a different divergent power from each other by the slots 33S recessively formed in the incident surface of the screen electrode 33, which will now be described in more detail.

The vertical electron beam formed at the position where the crossover point P1 is formed adjacently to the cathode 31 takes a strong divergent power externally and passes through the peripheral portion of the prefocus lens L3, thereby taking a strong convergent power by the prefocus lens L3. However, the horizontal electron beam positioned where the crossover point P2 is far from the cathode 31 passes through the center of the prefocus lens L3, thereby taking a less convergent power than the vertical electron beam. That is to say, differently from the conventional electron gun reducing the emitting angle from the crossover point, the electron gun according to the present invention diverges externally the electron beam crossed over at the adjacent position with the cathode, thereby making the emitting angle from the crossover point larger and making the focusing at the prefocus lens L3 strong.

Figure 11:
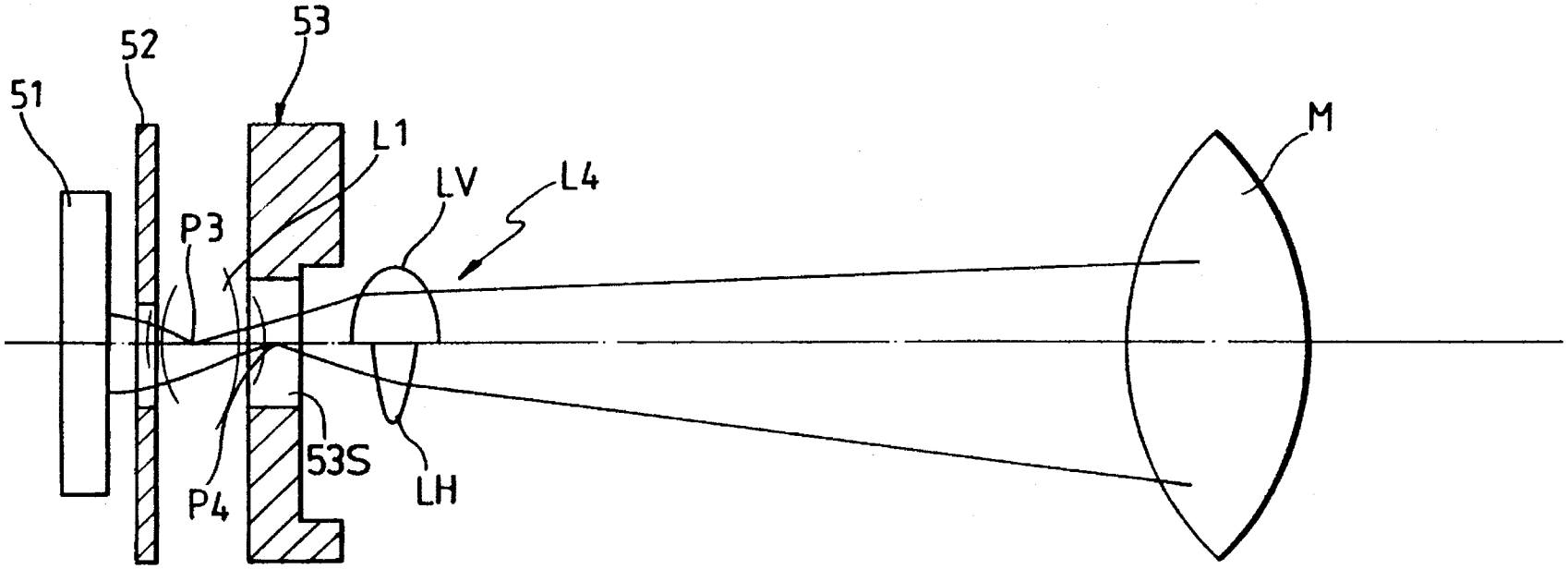
FIG. 11 is a cross-sectional view of the horizontally and vertically cut away sections of the triode of the electron gun according to another embodiment of the present invention taken on the basis of the center line thereof.

Also, as shown in FIG. 11, if horizontally elongated electron beam passing holes are formed in a control electrode 52 and horizontally elongated slots 53S encompassing the electron beam passing holes are formed in the emitting surface of the screen 53, the cathode lens L1 formed between the cathode 51 and screen electrode 53 is weakly formed horizontally and is strongly formed vertically. Therefore, the electron beam emitted from the cathode 31 passes through the cathode lens L1 strongly formed vertically so form a crossover point P3 at a position near from the cathode 51. Also, the horizontal electron beam emitted from the cathode 51 passes through the cathode lens L1 formed weakly in the horizontal direction to then form a crossover point P4 at a position relatively far from the cathode. In such a manner, the electron beams whose vertical and horizontal crossover points are differently formed pass through the prefocus lens L4. In the prefocus lens L4, a vertical lens LV is formed more strongly compared to a horizontal lens LH because of the horizontally elongated slot 53S formed in the emitting surface of the screen electrode 53. Therefore, the vertical electron beam passing through the prefocus lens L4 takes a strong convergent power, and the horizontal election beam takes a relatively weak convergent power by the weak horizontal lens LH. Here, reference character M is a main lens.

Figure 12:
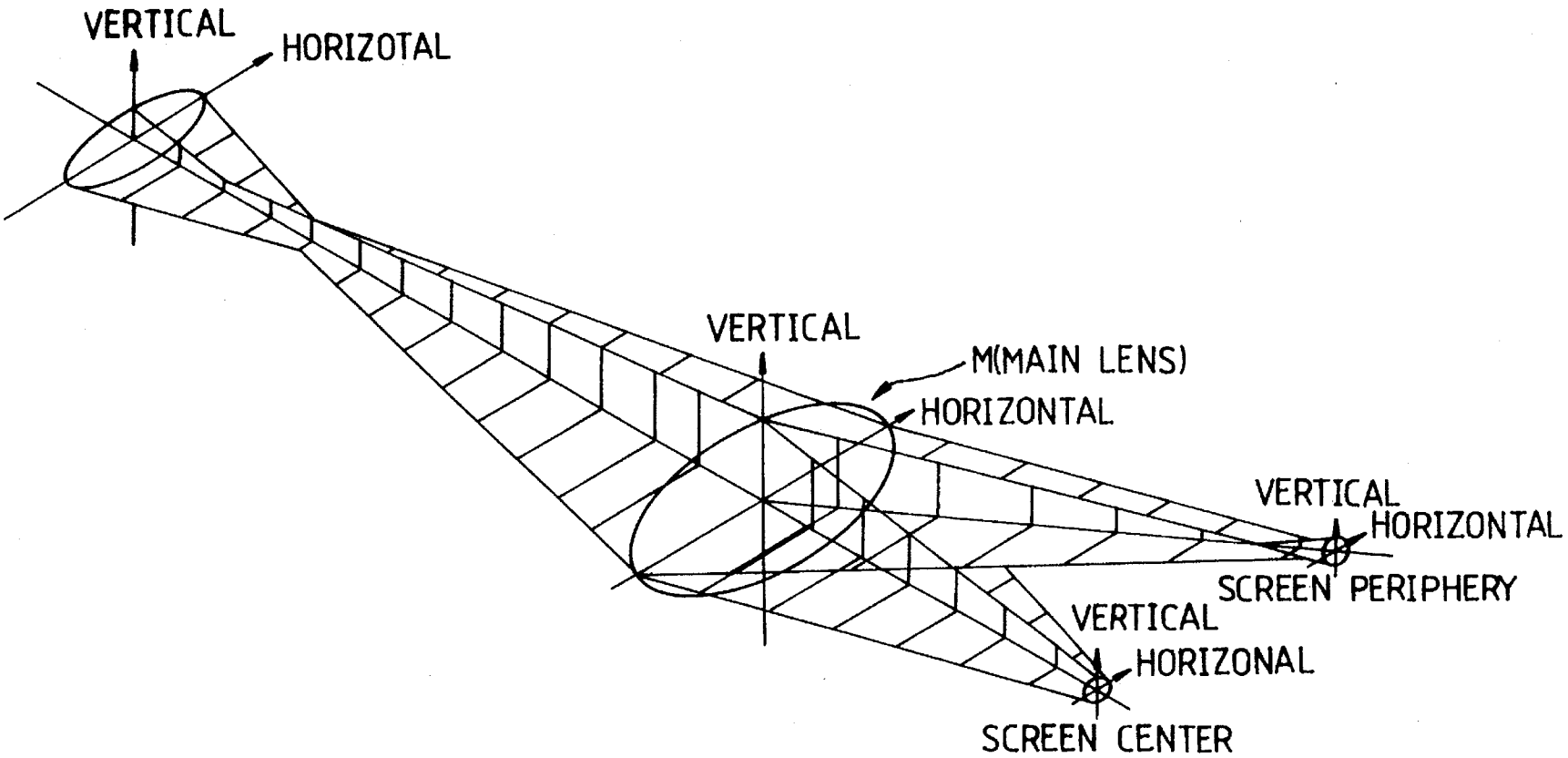
FIG. 12 depicts the trajectories of vertical and horizontal electron beams of the electron gun according to the present invention.

The cross-sectional shape of the electron beam made incident to the main lens by such operation as described above is a horizontally elongated oval as shown in FIG. 12, whose space occupied by the vertical beam is small. Therefore, since the radius of the electron beam in the vertical direction becomes smaller in radius within the main lens M to thereby pass through the central portion of the main lens M, it experiences less spherical aberration. Furthermore, since the radius in the vertical direction of the electron beam which passes through the nonhomogeneous magnetic field of the deflection yoke is reduced, the electron beam undergoes less deflection aberration in the vertical direction due to the vertical deflection magnetic field formed by a focusing field. As a result, the reduction of the focusing characteristics caused by an over-focus around the fluorescent surface can be prevented.

The following table shows the relation between the radii of electron beams passing through the prefocus lens L3 and main lens M depending on the size of the horizontally elongated electron beam passing hole 32H formed in the screen electrode, which was obtained by the inventor's experimentation.

| size of slot in screen electrode (width × depth) | radius of electron beam passing through prefocus lens | radius of electron beam passing through main lens |
|---|---|---|
| 3.0 mm × 0.9 mm | 0.130 mm | 0.598 mm |
| 3.0 mm × 1.1 mm | 0.121 mm | 0.629 mm |
| 3.0 mm × 1.3 mm | 0.115 mm | 0.647 mm |

As shown in the above table, it is understood that the incident angle of the vertical electron beam becomes larger toward the prefocus lens but the incident angle thereof becomes smaller toward the main lens as the depth of the slot of the screen electrode is reduced.

Figure 13:
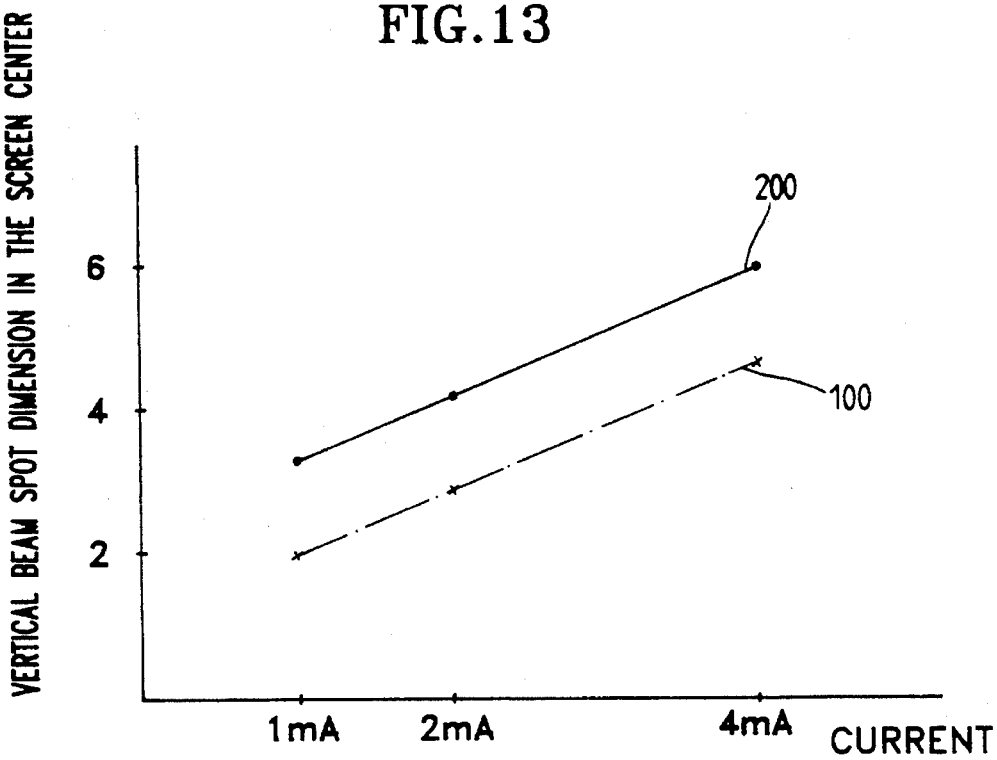
FIG. 13 is a graph showing the relationship between the current and magnitude of the vertical electron beam spot of the electron gun.

FIG. 13 which depicts the relationship between the current and the vertical dimension of the electron beam spot landed onto the central portion of the fluorescent screen surface, shows that the vertical size of the electron beam spot of the electron gun according to the present invention indicated by a broken line 100 is less than that of the conventional electron gun indicated by a solid line 200. This means that the focusing characteristic in the vertical direction of the electron beam of the electron gun according to the present invention has been improved compared to that of the conventional one.

Meanwhile, in the focusing characteristic in the horizontal direction of the electron beam emitted from the cathode 31, in contrast with the main lens M which is a focusing lens, since the horizontal deflection magnetic field formed by the deflection yoke is formed by a diverging magnetic field, the electron beam is automatically self-focused. Thus, although the horizontal radius of the electron beam in the main lens M is large, the best focusing characteristic is obtained.

Figure 14:
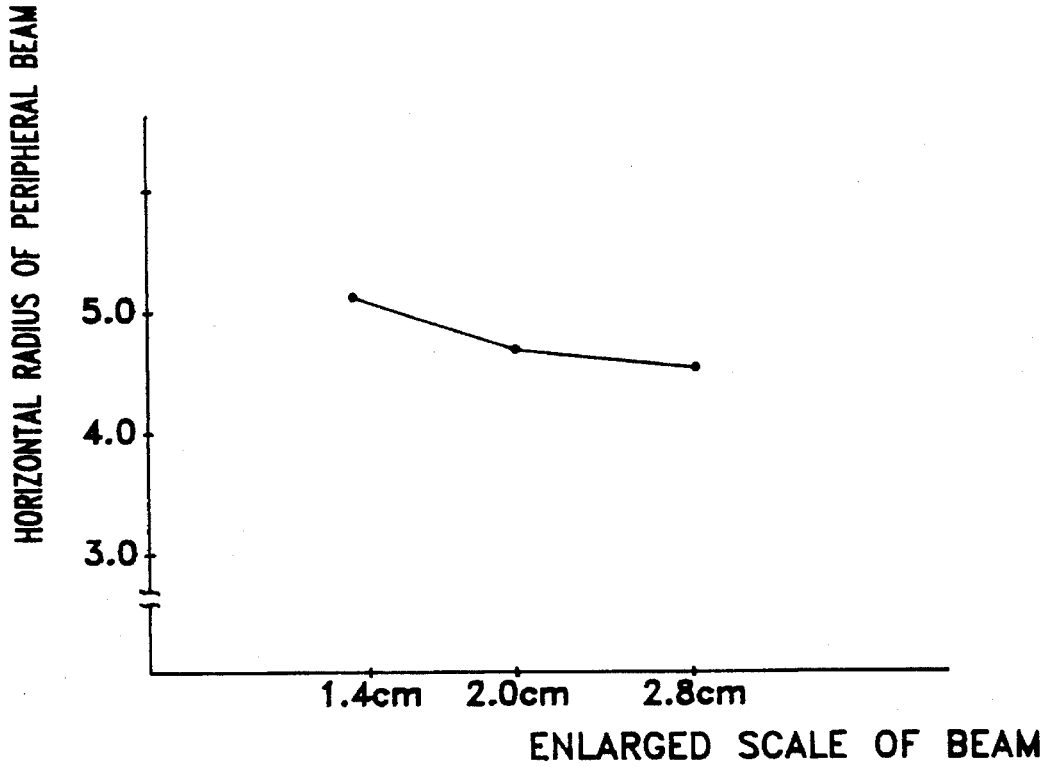
FIG. 14 is a graph showing the relationship between the horizontal radius of the cross-sectional surface of an electron beam incident to the main lens and the enlarged scale of the horizontal radius of the electron beam on the screen.

FIG. 14 is a graph showing the relationship between the horizontal radius of the electron beam in the main lens and the size of the electron beam spot on a screen. As shown in the graph, the larger the horizontal radius of the electron beam in the main lens, the smaller the enlarged scale of the electron beam spot landed onto the screen.

As described above, according to the electron gun for a color cathode ray tube of the present invention, by forming the electron beam passing hole of the control electrode of the triode in a horizontally elongated shape and the horizontally elongated slot in the incident surface of the screen electrode opposed to the control electrode, the crossover points of the vertical and horizontal components of the electron beams are separated, thereby forming a small object point radius vertically and preventing the deterioration of the focusing characteristics in the center of the screen. Also, since the section shape of the electron beam incident to the main lens becomes a horizontally elongated oval, the deterioration of the vertical beam due to the spherical aberration can be reduced.

The present invention is not limited to the embodiment of the electron gun described above but it is applicable to the triodes of all in-line type electron guns, irrespective of the connection of the electrodes comprising of the electron gun.

What is claimed is:

1. An electron gun for a color cathode ray tube comprising:

a triode including three cathodes, a control electrode, a screen electrode including an incident surface opposed to said control electrode, and a main lens for focusing and accelerating an electron beam formed by said triode, wherein said control electrode includes a plurality of horizontally elongated electron beam passing holes, each electron beam passing hole having a long axis disposed in an arrangement direction of the plurality of electron beam passing holes, and said screen electrode includes a plurality of horizontally elongated slots, each slot encompassing a corresponding one of the electron beam passing holes and having a long axis disposed in the arrangement direction of the plurality of electron beam passing holes, the horizontally elongated slots being recessed from the incident surface of said screen electrode.

2. The electron gun for a color cathode ray tube as claimed in claim 1, wherein the electron beam passing holes in said control electrode are rectangular.

3. The electron gun for a color cathode ray tube as claimed in claim 1, wherein the horizontally elongated slots in said screen electrode are rectangular.

4. An electron gun for a color cathode ray tube comprising:

a triode including three cathodes, a control electrode, a screen electrode opposed to said control electrode, and a main lens for focusing and accelerating an electron beam formed by said triode, wherein said control electrode includes a plurality of horizontally elongated electron beam passing holes, each electron beam passing hole having a long axis disposed in an arrangement direction of the plurality of electron beam passing holes, said screen electrode includes a first member having a plurality of horizontally elongated slots and a second member opposed to said main lens and having a plurality of electron beam passing holes, the first and second members being coupled so that each slot in said first member encompasses a corresponding one of the electron beam passing holes in said second member.

5. An electron gun for a color cathode ray tube as claimed in claim 4, wherein the electron beam passing hole formed in said control electrode is rectangular.

6. An electron gun for a color cathode ray tube as claimed in claim 4, wherein the electron beam passing hole formed in said first member is rectangular.

7. An electron gun for a color cathode ray tube comprising:

a triode including three cathodes, a control electrode, a screen electrode opposed to the control electrode, and a main lens for focusing and accelerating an electron beam formed by said triode, wherein said control electrode includes an emitting surface opposite said main lens and a plurality of horizontally elongated electron beam passing holes, each electron beam passing hole having a long axis disposed in an arrangement direction of the plurality of electron beam passing holes and said screen electrode includes a plurality of horizontally elongated slots recessed from the emitting surface of said screen electrode, each slot encompassing a corresponding one of the electron beam passing holes.

8. The electron gun for a color cathode ray tube as claimed in claim 7, wherein the horizontally elongated slots in said screen electrode are rectangular.

* * * * *